US012601101B2

(12) United States Patent
Reger

(10) Patent No.: US 12,601,101 B2
(45) Date of Patent: Apr. 14, 2026

(54) PUMP ASSEMBLY FOR DISPENSER CLEANING IN A WASHING MACHINE APPLIANCE

(71) Applicant: Haier US Appliance Solutions, Inc., Wilmington, DE (US)

(72) Inventor: Todd Anthony Reger, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 68 days.

(21) Appl. No.: 18/582,202

(22) Filed: Feb. 20, 2024

(65) Prior Publication Data

US 2025/0263881 A1 Aug. 21, 2025

(51) Int. Cl.

| | |
|---|---|
| ***D06F 39/08*** | (2006.01) |
| *D06F 33/43* | (2020.01) |
| *D06F 39/02* | (2006.01) |

(52) U.S. Cl.

CPC ..... *D06F 39/085* (2013.01); *D06F 39/088* (2013.01); *D06F 33/43* (2020.02); *D06F 39/02* (2013.01); *D06F 39/083* (2013.01)

(58) Field of Classification Search

CPC ..... D06F 39/088; D06F 39/085; D06F 39/02; D06F 39/083; D06F 33/43

See application file for complete search history.

(56) References Cited

U.S. PATENT DOCUMENTS

| | | | | |
|---|---|---|---|---|
| 2,792,701 | A * | 5/1957 | Bochan | D06F 39/024 68/17 A |
| 2,974,667 | A * | 3/1961 | Cousins | A41C 1/00 D2/702 |
| 3,736,773 | A * | 6/1973 | Waugh | D06F 39/024 68/17 A |
| 4,467,627 | A * | 8/1984 | Platt | D06F 39/085 68/17 R |
| 7,555,923 | B2 | 7/2009 | Kim et al. | |
| 8,926,275 | B2 | 1/2015 | Badafem et al. | |
| 10,351,987 | B2 | 7/2019 | Marioni | |
| 10,513,817 | B2 | 12/2019 | Kim et al. | |
| 10,557,469 | B2 | 2/2020 | Han et al. | |
| 10,626,537 | B2 | 4/2020 | Kim et al. | |
| 10,718,081 | B2 | 7/2020 | Choi et al. | |
| 10,941,785 | B2 | 3/2021 | Cho et al. | |
| 11,293,126 | B2 | 4/2022 | Park et al. | |

(Continued)

FOREIGN PATENT DOCUMENTS

| | | | | |
|---|---|---|---|---|
| DE | 102014100074 | A1 * | 7/2015 | D06F 39/083 |
| EP | 0597513 | A1 * | 5/1994 | D06F 39/10 |

(Continued)

*Primary Examiner* — Benjamin L Osterhout

(74) *Attorney, Agent, or Firm* — Dority & Manning, P.A.

(57) ABSTRACT

A washing machine appliance includes a wash tub positioned within a cabinet and defining a wash chamber, a wash basket rotatably mounted within the wash tub for receiving a load of clothes, a dispensing assembly mounted within the cabinet for selectively adding wash fluid into the wash tub, and a pump assembly in fluid communication with a sump of the wash tub. The pump assembly includes a recirculation conduit fluidly coupled to the dispensing assembly and a recirculation pump for selectively urging a flow of wash fluid through the recirculation conduit.

16 Claims, 7 Drawing Sheets

(56) References Cited

U.S. PATENT DOCUMENTS

| | | | | |
|---|---|---|---|---|
| 11,371,176 | B2 | 6/2022 | Park et al. | |
| 2015/0121629 | A1 | 5/2015 | Jang | |
| 2017/0088999 | A1 | 3/2017 | Nash et al. | |
| 2017/0159223 | A1 * | 6/2017 | Alexander | D06F 39/02 |
| 2018/0242814 | A1 * | 8/2018 | Welch | D06F 39/20 |
| 2020/0199804 | A1 | 6/2020 | Magnusson | |
| 2023/0151523 | A1 | 5/2023 | Roetker et al. | |

FOREIGN PATENT DOCUMENTS

| | | | | | |
|---|---|---|---|---|---|
| EP | 1688529 | A1 * | 8/2006 | D06F 39/083 |
| EP | 3839127 | A1 * | 6/2021 | D06F 33/00 |
| KR | 20050098521 | A * | 10/2005 | D06F 33/43 |
| WO | WO2009141070 | A1 | 11/2009 | |
| WO | WO2012022107 | A1 | 2/2012 | |
| WO | WO2013098037 | A1 | 7/2013 | |
| WO | WO2016012152 | A1 | 1/2016 | |
| WO | WO2016188915 | A1 | 12/2016 | |
| WO | WO-2017059896 | A1 * | 4/2017 | A47L 15/0049 |
| WO | WO-2024021299 | A1 * | 2/2024 | D06F 39/02 |

* cited by examiner

PUMP ASSEMBLY FOR DISPENSER CLEANING IN A WASHING MACHINE APPLIANCE

FIELD OF THE INVENTION

The present subject matter relates generally to washing machine appliances, or more specifically, to the dispensing assemblies of washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Certain conventional washing machine appliances include dispensing assemblies that are configured to dispense water, wash fluid, and/or other additives into the wash chamber at various stages of the operating cycle to facilitate the cleaning of articles located therein. Notably, however, various grime, dirt, soil, and additives may tend to accumulate within the dispensing assemblies. In addition, mold and mildew may tend to form due to residual water and additives that remain in the dispensing assembly after an operating cycle. This build-up tends to reduce the effectiveness of operating cycles, generate foul smells in the appliance and on articles cleaned therein, and generally result in consumer dissatisfaction and service calls. Conventional methods for dealing with this build-up includes cleaning the dispensing assembly using the washing machine water inlet valves, but these methods use additional water and rely on water inlet pressure that has high variation.

Accordingly, a washing machine appliance having features for facilitating improved cleaning of the dispensing assembly would be desirable. More specifically, a system for cleaning the dispensing assembly with consistent water pressure and minimal water usage would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided including a wash tub positioned within a cabinet and defining a wash chamber, a wash basket rotatably mounted within the wash tub for receiving a load of clothes, a dispensing assembly mounted within the cabinet for selectively adding wash fluid into the wash tub, and a pump assembly in fluid communication with a sump of the wash tub. The pump assembly includes a recirculation conduit fluidly coupled to the dispensing assembly and a recirculation pump for selectively urging a flow of wash fluid through the recirculation conduit.

In another exemplary embodiment, a pump assembly for a washing machine appliance is provided. The washing machine appliance includes a dispensing assembly mounted within a cabinet for selectively adding wash fluid into a wash tub. The pump assembly includes a recirculation conduit fluidly coupled to the dispensing assembly and a bi-directional pump for selectively urging a flow of wash fluid through the recirculation conduit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
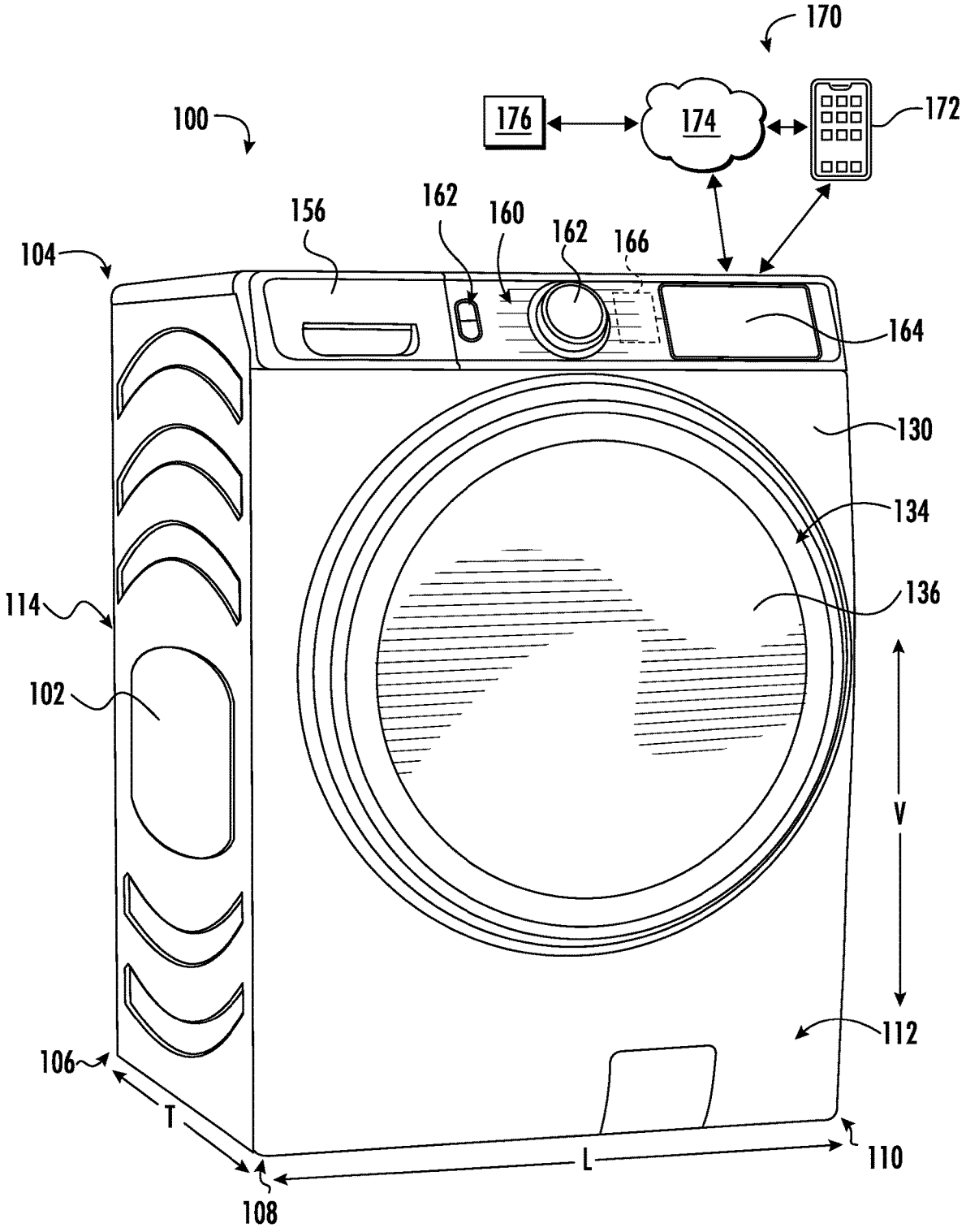
FIG. 1 provides a perspective view of a washing machine appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
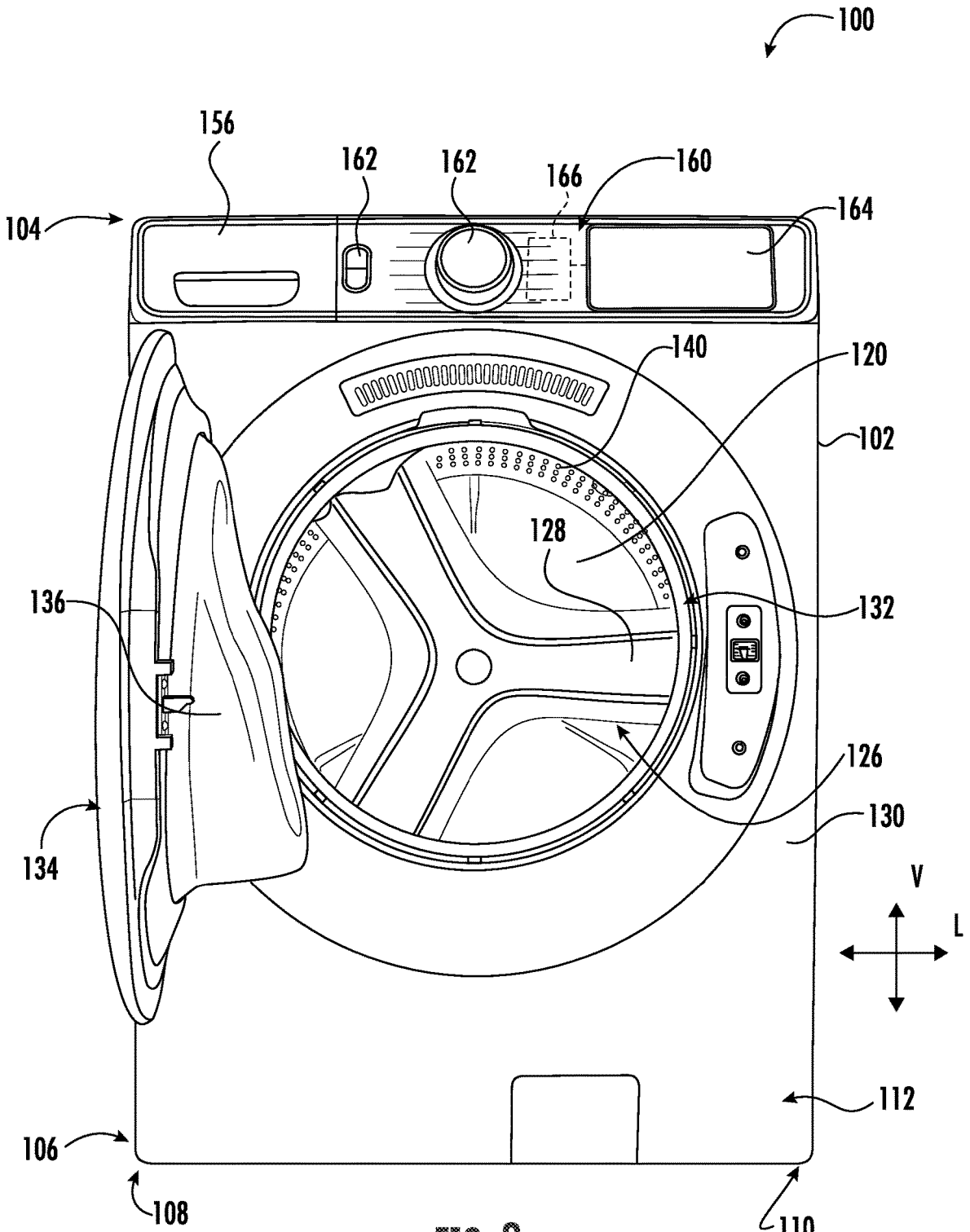
FIG. 2 provides a front view of the example washing machine appliance of FIG. 1 with a door in the open position according to an example embodiment of the present subject matter.
Figure 3:
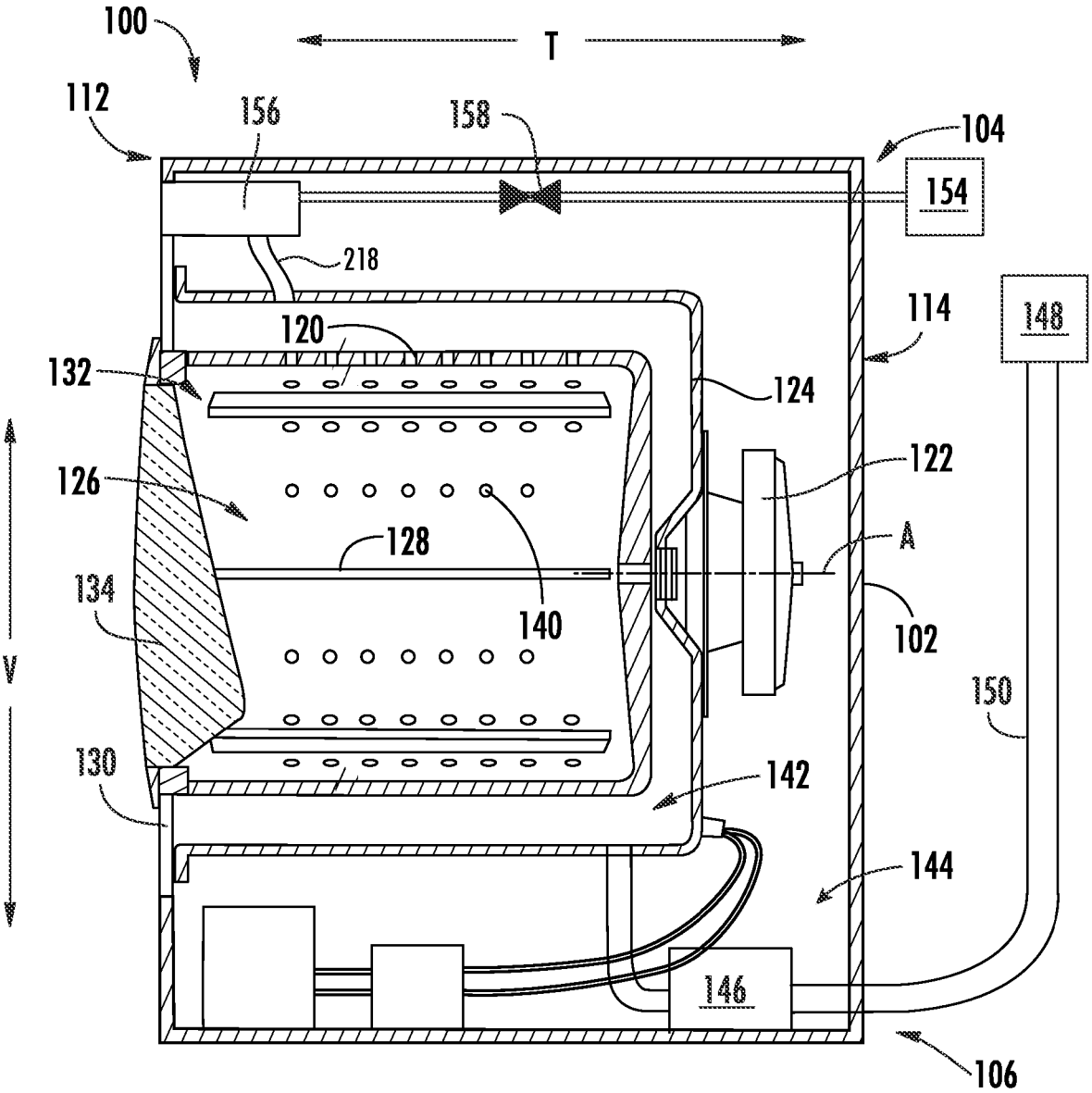
FIG. 3 provides a side cross-sectional view of the example washing machine appliance of FIG. 1 according to an example embodiment of the present subject matter.
Figure 4:
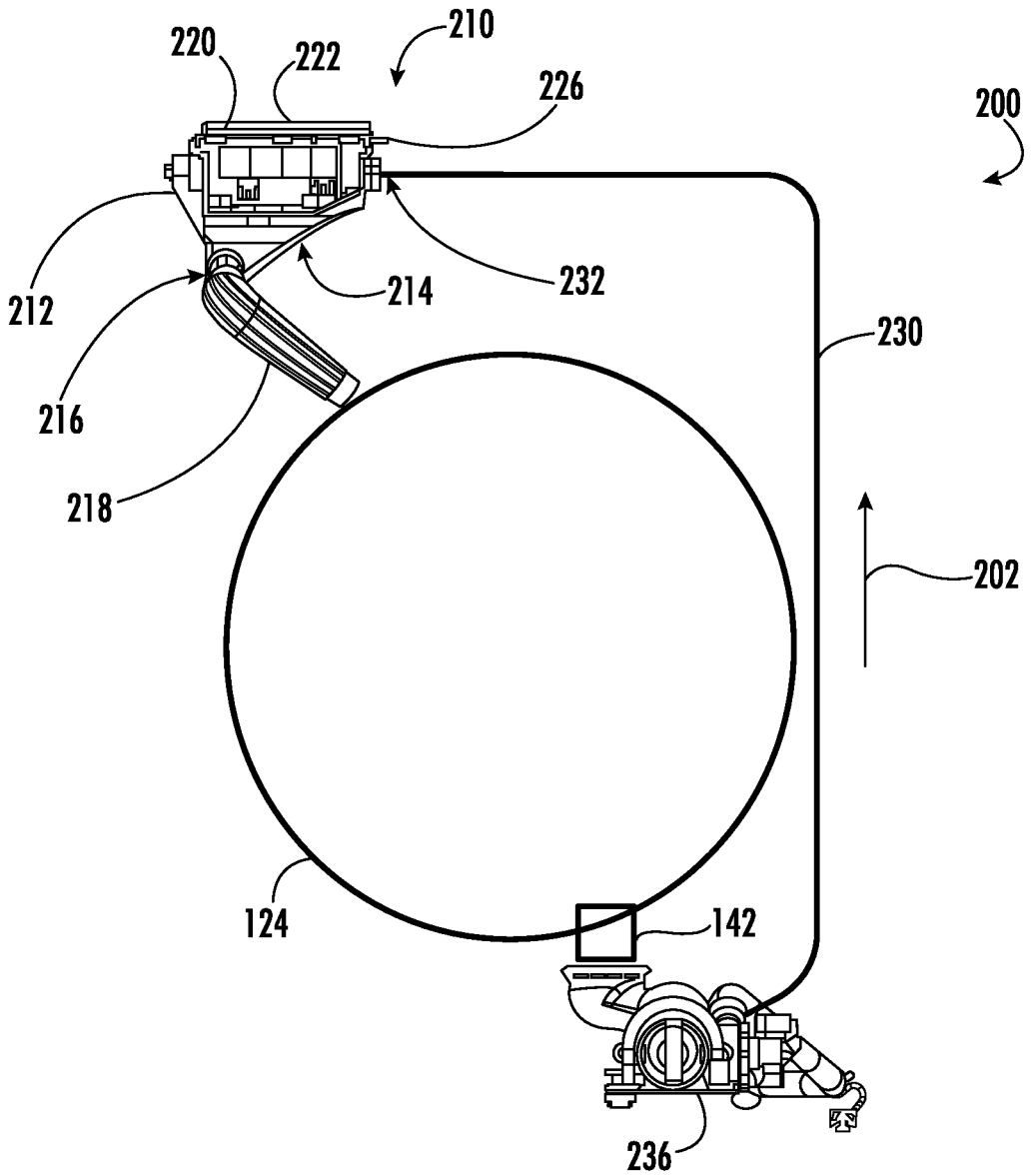
FIG. 4 provides a schematic view of a fluid circulation assembly of the example washing machine appliance of FIG. 1 according to an example embodiment of the present subject matter.
Figure 5:
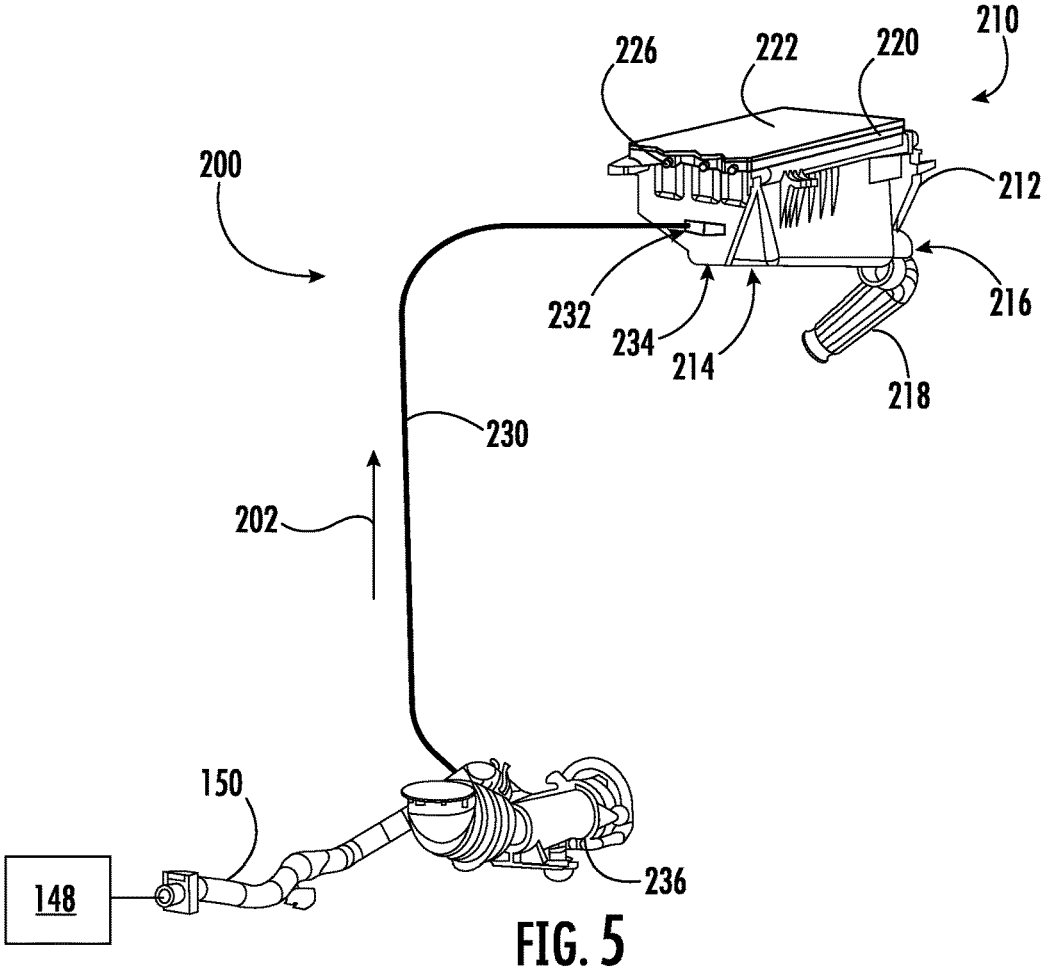
FIG. 5 provides another schematic view of the example fluid circulation assembly of FIG. 4 illustrating a recirculation conduit according to an example embodiment of the present subject matter.
Figure 6:
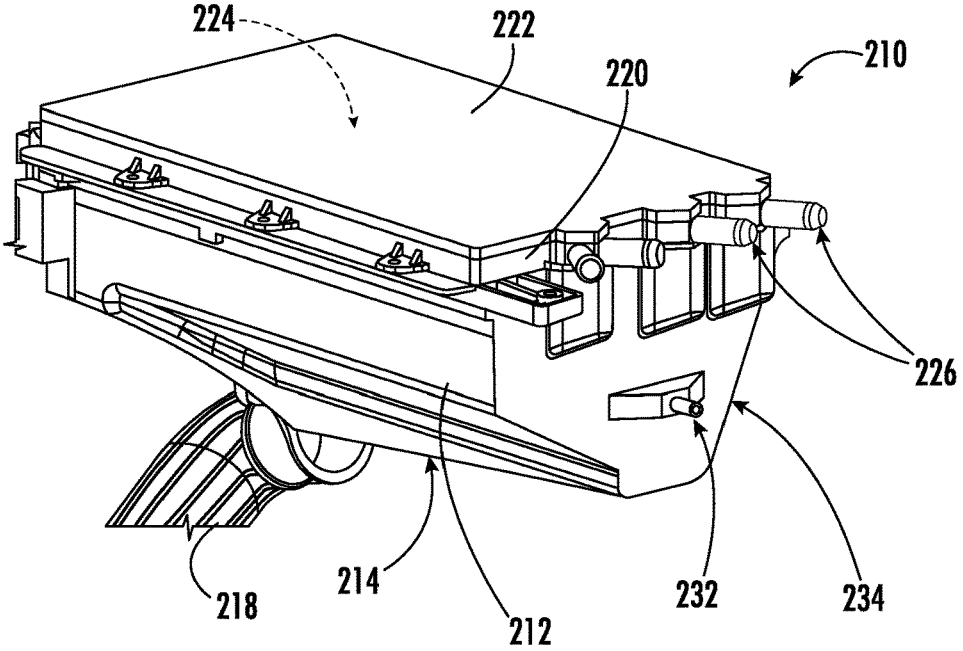
FIG. 6 provides a rear perspective view of a dispensing assembly of the example fluid circulation assembly of FIG. 4 according to an example embodiment of the present subject matter.

Referring now to the figures, FIG. 1 is a perspective view of an exemplary horizontal axis washing machine appliance 100, FIG. 2 is a front view of washing machine appliance 100, and FIG. 3 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIGS. 2 and 3, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 3, a plurality of ribs 128 extends from basket 120 into wash chamber 126. In this manner, for example, ribs 128 may lift articles disposed in wash basket 120 during rotation of wash basket 120.

Referring generally to FIGS. 1 through 3, cabinet 102 also includes a front panel 130 which defines a chamber opening 132 that permits user access to wash basket 120 of wash tub 124. More specifically, washing machine appliance 100 includes a door 134 that is positioned over chamber opening 132 and is rotatably mounted to front panel 130. In this manner, door 134 permits selective access to chamber opening 132 by being movable between an open position (FIG. 2) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not labeled) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 3, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout (such as supply conduit 218) may be configured for directing a flow of fluid into wash tub 124. For example, supply conduit 218 may be in fluid communication with a water supply 154 (FIG. 2) in order to direct fluid (e.g., clean water or wash fluid) into wash tub 124. Supply conduit 218 may also be in fluid communication with the sump 142. For example, pump assembly 144 may direct wash fluid disposed in sump 142 to supply conduit 218 in order to circulate wash fluid in wash tub 124.

As illustrated in FIG. 3, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to supply conduit 218 to facilitate the complete and accurate dispensing of wash additive.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through chamber opening 132, and washing operation is initiated through operator manipulation of input selectors 162. Wash tub 124 is filled with water, detergent, and/or other fluid additives, e.g., via supply conduit 218 and or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through chamber opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring still to FIG. 1, a schematic diagram of an external communication system 170 will be described according to an exemplary embodiment of the present subject matter. In general, external communication system 170 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 170 may be used to transfer data or other information to improve performance of one or more external devices or appliances and/or improve user interaction with such devices.

For example, external communication system 170 permits controller 166 of washing machine appliance 100 to communicate with a separate device external to washing machine appliance 100, referred to generally herein as an external device 172. As described in more detail below, these communications may be facilitated using a wired or wireless connection, such as via a network 174. In general, external device 172 may be any suitable device separate from washing machine appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with washing machine appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control washing machine appliance 100, etc. In addition, external device 172 and remote server 176 may communicate with washing machine appliance 100 to communicate similar information.

In general, communication between washing machine appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with washing machine appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Referring now generally to FIGS. 4 through 10, a fluid circulation assembly 200 that may be used with washing machine appliance 100 will be described according to example embodiments of the present subject matter. In general, fluid circulation assembly 200 may generally be configured for urging a flow of wash fluid (e.g., identified generally by reference numeral 202) throughout washing machine appliance 100. For example, the flow of wash fluid 202 may be water, detergent, additives, or some mixture thereof. According to example embodiments, fluid circulation assembly 200 may be configured to circulate the flow of wash fluid 202 within washing machine appliance 100 to facilitate cleaning of a load of articles or may be configured to discharge the flow of wash fluid 202 to an external drain 148. Although fluid circulation assembly 200 will be described below according to an example embodiment, it should be appreciated that variations and modifications may be made while remaining within the scope of the present subject matter.

According to the illustrated embodiment, fluid circulation assembly 200 may generally include a dispensing assembly 210 that is configured to receive and distribute the flow of wash fluid 202. For example, according to the illustrated embodiment, dispensing assembly 210 may generally include a dispenser manifold or a dispenser housing 212 that is positioned within or recessed within cabinet 102, e.g., at a top corner of front panel 130. According to the illustrated embodiment, dispenser housing 212 may be an open reservoir positioned at a bottom of dispensing assembly 210 and may include angled collecting wall 214 for directing fluids within dispenser housing 212 toward a discharge port 216. As shown for example in FIGS. 4 and 5, discharge port 216 may be fluidly coupled to a supply conduit 218 that is fluidly coupled to wash tub 124. In this manner, the flow of wash fluid 202 that is passed into dispenser housing 212 may be directed to the force of gravity into wash tub 124, e.g., to facilitate operation of washing machine appliance 100.

As best illustrated in FIGS. 4 through 7, dispensing assembly 210 may further include a shower plate 220 and a top cover 222 that is positioned over the shower plate 220 to define a water supply reservoir 224. Dispensing assembly 210 may further include a plurality of freshwater supply inlets 226 that are positioned at a rear of shower plate 220 for providing flows of hot and/or cold water into water supply reservoir 224, e.g., from water supply 154. In general, shower plate 220 may include a plurality of apertures or perforations for discharging the freshwater from water supply reservoir 224 down into dispenser housing 212. In this manner, fresh water and/or additives may be showered or flooded within dispenser housing 212 where they may be mix prior to passing into wash tub 124 through supply conduit 218.

In addition, as described briefly above, dispensing assembly 210 may include a detergent drawer 156 that is slidably mounted within dispenser housing 212 for receiving one or more wash additives or detergents. In this regard, a user may slide detergent drawer 156 out from front 112 of cabinet 102 for supplying wash additives needed for a wash cycle. Detergent drawer 156 may then slide back into dispensing assembly 210 where water supply 154 may selectively dispense fresh water to flush out one or more compartments of detergent drawer 156 and to create the flow of wash fluid 202.

Notably, as explained briefly above, dispensing assembly 210 may tend to collect residue, grime, or other build up due to its frequent exposure to the flow of wash fluid 202, detergent, and other additives. Over time, this residue may result in the buildup of mold or mildew, thereby resulting in musty smells resulting in consumer dissatisfaction and/or repeated maintenance and cleaning. Accordingly, it may be desirable to periodically flush dispensing assembly 210 with water to facilitate the cleaning of this grime and build up. Conventional methods for flushing and cleaning dispensing assembly 210 may include the supply of fresh water from water supply 154. However, the use of freshwater for cleaning in this manner may deteriorate the water efficiency of the unit. In addition, variance in water supply pressure may result in inconsistent cleaning. Accordingly, aspects of the present subject matter may be directed to improved systems and methods for flushing out and cleaning dispensing assembly 210.

For example, according to the illustrated embodiment, fluid circulation assembly 200 may further include a recirculation conduit 230 that is fluidly coupled to dispensing assembly 210. In this regard, for example, recirculation conduit 230 may provide fluid communication between sump 142 and an inlet port 232 that is defined on a rear wall 234 of dispenser housing 212. However, it should be appreciated that inlet port 232 could be positioned at other locations as well, such as on the sidewalls or front wall of dispenser housing 212. In addition, fluid circulation assembly 200 may include a recirculation pump 236 for selectively urging the flow of wash fluid 202 from sump 142, through recirculation conduit 230, and into dispenser housing 212 through inlet port 232.

Figure 7:
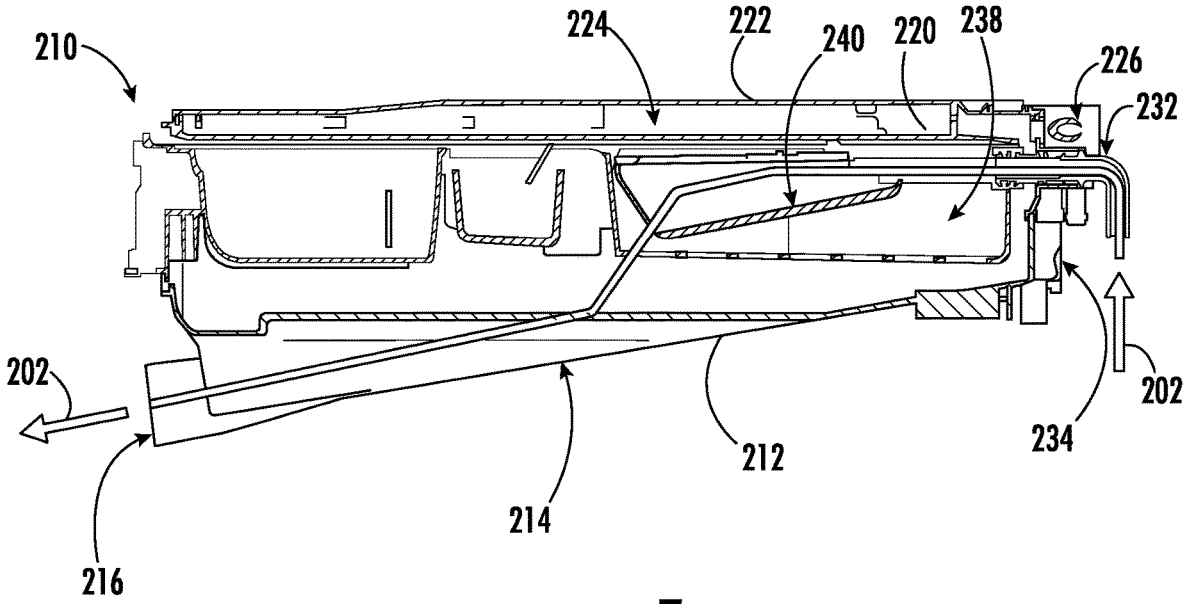
FIG. 7 provides a cross-sectional view of the example dispensing assembly of FIG. 6 according to an example embodiment of the present subject matter.

As shown for example in FIG. 7, detergent drawer 156 may further include a filtering chamber 238 which is configured to receive a filter element 240. In general, filter element 240 may be a pleated filter, a mesh screen, a carbon filter, a sponge filter, or any other suitable filtering element for extracting undesirable particulates or other matter from the flow of wash fluid 202. In this manner, the flow of wash fluid 202 that passes into dispenser housing 212 may be cleaned or filtered prior to flushing out dispensing assembly 210.

In general, recirculation pump 236 may be any suitable type and configuration of fluid pump for urging the flow of wash fluid 202. For example, according to an example embodiment, recirculation pump 236 may be a bidirectional direct current (DC) pump. According to such an embodiment, fluid circulation assembly 200 may further include a drain conduit fluidly coupled to an external drain (e.g., such as drain hose 150 coupled to external drain 148). According to such an embodiment, recirculation pump 236 may be fluidly coupled to both recirculation conduit 230 and drain hose 150 for selectively urging the flow of wash fluid 202 through one or both of drain hose 150 and recirculation conduit 230. For example, recirculation pump 236 may operate in one direction to discharge wash fluid 202 through drain hose 150 to external drain 148 and may operate in the other direction to recirculate the flow of wash fluid 202 through recirculation conduit 230. It should be appreciated that according to alternative embodiments, a dedicated drain pump may be used to discharge wash fluid 202 instead of relying on recirculation pump 236.

According to example embodiments of the present subject matter, dispensing assembly 210 may include additional features for improving the distribution and flow of wash fluid 202 to facilitate improved cleaning of dispenser housing 212 and dispensing assembly 210. For example, inlet port 232 may generally be fan-shaped or may increase in width from recirculation conduit 230 to improve the distribution of the flow of wash fluid 202 out of inlet port 232.

Figure 10:
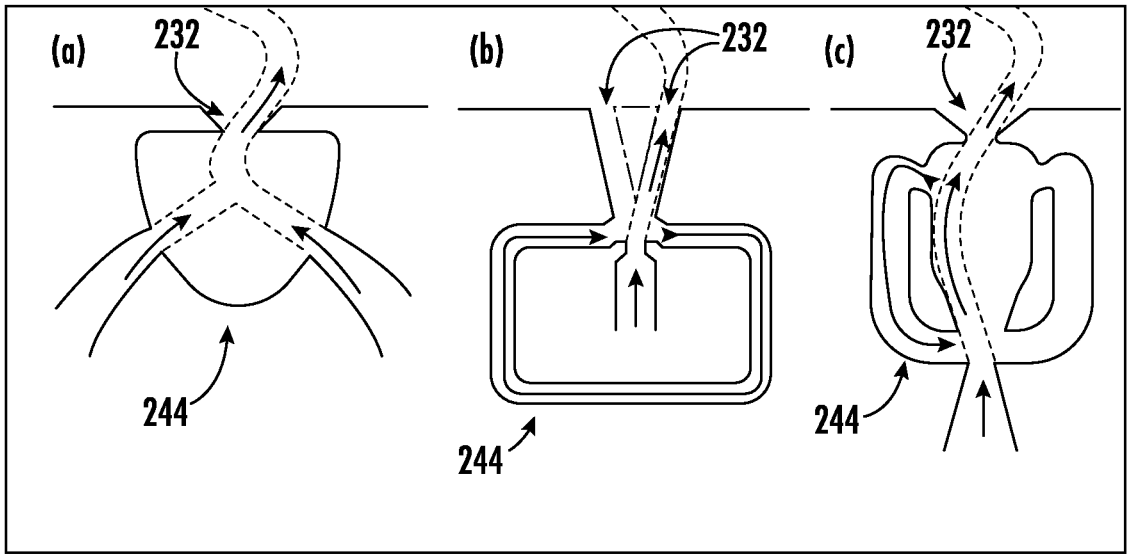
FIG. 10 provides a schematic view of various inlet ports that may be used with the example dispenser manifold of FIG. 8 according to an example embodiment of the present subject matter.

In addition, as shown for example in FIG. 10, inlet port 232 may include various fluid oscillators circuits 244 which are designed to randomize the flow of wash fluid 202 exiting inlet port 232. Examples of such fluid oscillators circuits 244 are illustrated in FIG. 10, but these illustrations are not intended to be limiting. In general, fluid oscillators circuits 244 operate by passing the flow of wash fluid 202 through various supply lines and mixing chambers to agitate or create oscillations within the flow of wash fluid 202 exiting inlet port 232. One skilled in the art will understand that various other fluid oscillators circuits 244 are possible and within the scope of the present subject matter.

Figure 8:
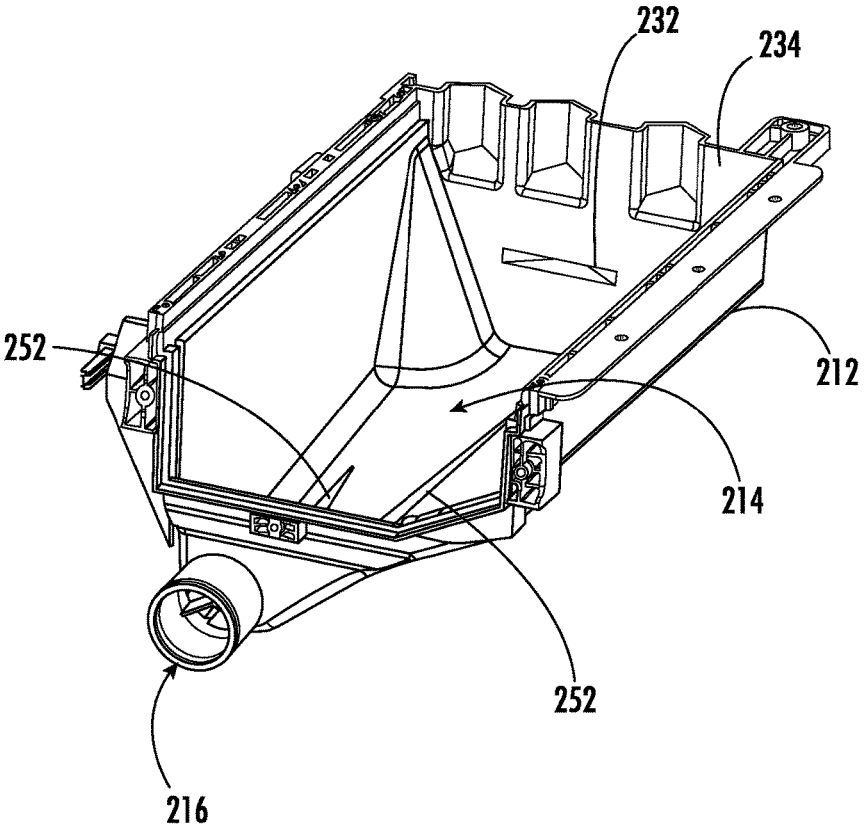
FIG. 8 provides a perspective view of a dispenser manifold of the example dispensing assembly of FIG. 6 according to an example embodiment of the present subject matter.
Figure 9:
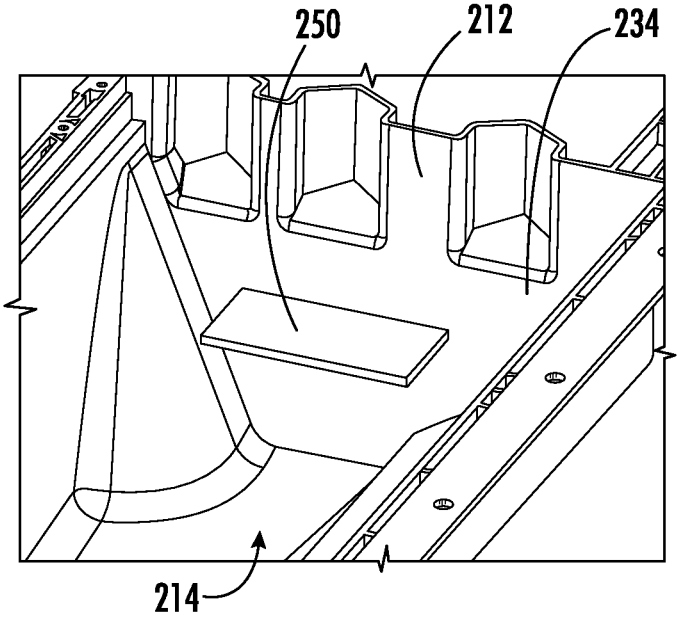
FIG. 9 provides a close-up perspective view of an inlet port of the example dispenser manifold of FIG. 8 according to an example embodiment of the present subject matter.

In addition, referring now specifically to FIGS. 8 and 9, dispensing assembly 210 may further include one or more dispersion fins 250 that extend from dispenser housing 212 adjacent inlet port 232 for directing the flow of wash fluid 202. For example, dispersion fins 250 may include a single flat plate positioned above inlet port 232 for preventing the flow of wash fluid 202 from passing upward as it exits inlet port 232. According to still other embodiments, dispersion fins 250 may be angled downward to direct the flow of wash fluid 202 onto angled collecting wall 214 and improve the flushing of dispensing assembly 210. It should be appreciated that the number, size, shape, and configuration of dispersion fins 250 may vary while remaining within the scope of the present subject matter. For example, dispersion fins 250 may have an arcuate profile, may include additional fins or water directing features, etc.

As shown for example in FIGS. 8 and 9, dispenser housing 212 may further define one or more distribution ribs 252 that extend from dispenser housing 212 for directing a flow of wash fluid throughout dispenser housing 212. For example, distribution ribs 252 may be aligned along angled collecting wall 214 for directing a flow of wash fluid 202 into regions where grime build-up is common or where frequent cleaning is desired. It should be appreciated that dispenser housing 212 may include additional features and geometries to facilitate improved cleaning of dispensing assembly 210.

It should be appreciated that various features of dispensing assembly 210 may be formed from any suitably rigid material. For example, according to exemplary embodiments, dispenser housing 212, shower plate 220, and top cover 222 may be formed by injection molding, e.g., using a suitable plastic material, such as injection molding grade Polybutylene Terephthalate (PBT), Nylon 6, high impact polystyrene (HIPS), acrylonitrile butadiene styrene (ABS), polypropylene, or any other suitable blend of polymers. Alternatively, according to the exemplary embodiment, these components may be compression molded, e.g., using sheet molding compound (SMC) thermoset plastic or other thermoplastics. According to still other embodiments, portions of dispensing assembly 210 may be formed from any other suitable rigid material. In addition, it should be appreciated that one or more features of dispenser housing 212 may be integrally molded as a single component (e.g., such as dispersion fins 250, distribution ribs 252, etc.).

As explained herein, aspects of the present subject matter are generally directed to a washing machine with a DC drain pump to run in both a forward and a reverse direction, thereby directing a flow of water from the wash tub to either an external drain when the pump run in forward direction or to channel the water from the wash tub to a port on a dispenser assembly when pump run in reverse direction. As water reaches the dispenser assembly, it may flow through a fan-shaped port and collide with the inner surfaces and components of the dispenser assembly. The fan-shaped portion may include fins and may further aid in directing the flow of water within dispenser assembly effectively cleaning the internal surfaces and components of the dispenser. Single or multiple ribs can be employed above the port to obstruct upward water flow. These ribs may be angled to redirect water downward and can either be integrated into the dispenser component or attached separately using methods such as snaps or screws.

The present subject matter provides several advantages over existing dispensing assembly designs. For example, the system described herein does not disrupt the flow of water from the water valves, through the shower plate, and into the dispenser. Instead, it allows these geometries and flows to be optimized for the purpose of delivering wash additives to the wash tub, and is an additional feature that then cleans any residual residue. The system utilizes water that is already in the washing machine hydraulic circuit, and does not require additional water to be added to the cycle, thus minimizing impact on water efficiency (e.g., the Integrated Water Factor, Water Efficiency Ratio, etc.). In addition, the system provides high pressure water to the internal portion of the dispenser, and does not rely on home water pressure which can be quite low and/or unstable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a wash tub positioned within a cabinet and defining a wash chamber;

a wash basket rotatably mounted within the wash tub for receiving a load of clothes;

a dispensing assembly mounted within the cabinet for selectively adding wash fluid into the wash tub; and a pump assembly in fluid communication with a sump of the wash tub, the pump assembly comprising:

a dispenser housing defining an inlet port;

a recirculation conduit fluidly coupled to the dispensing assembly through the inlet port, wherein the inlet port comprises a fluid oscillator for oscillating or agitating the flow of wash fluid passing into the dispenser housing; and a recirculation pump for selectively urging a flow of wash fluid through the recirculation conduit.

2. The washing machine appliance of claim 1, wherein the inlet port is defined on a back wall of the dispenser housing.

3. The washing machine appliance of claim 1, wherein the inlet port defines a fan-shaped geometry to spread the flow of wash fluid.

4. The washing machine appliance of claim 1, wherein the dispensing assembly further comprises:

one or more dispersion fins extending from the dispenser housing adjacent the inlet port for directing the flow of wash fluid.

5. The washing machine appliance of claim 4, wherein the one or more dispersion fins are positioned above the inlet port along a vertical direction.

6. The washing machine appliance of claim 4, wherein the one or more dispersion fins are angled downward along a vertical direction to direct the flow of wash fluid downward.

7. The washing machine appliance of claim 4, wherein the one or more dispersion fins are integrally formed with the dispenser housing.

8. The washing machine appliance of claim 1, wherein the dispensing assembly further comprises:

one or more distribution ribs extending from the dispenser housing for directing the flow of wash fluid through a dispenser manifold.

9. The washing machine appliance of claim 1, further comprising:

a drain conduit fluidly coupled to an external drain, wherein the recirculation pump is a bi-directional pump fluidly coupled to the drain conduit for selectively urging the flow of wash fluid through the drain conduit to an external drain.

10. The washing machine appliance of claim 9, wherein the bi-directional pump is a direct current (DC) pump.

11. A pump assembly for a washing machine appliance, the washing machine appliance comprising a dispensing assembly mounted within a cabinet for selectively adding wash fluid into a wash tub, the pump assembly comprising:

a dispenser housing defining an inlet port;

a recirculation conduit fluidly coupled to the dispensing assembly through the inlet port, wherein the inlet port comprises a fluid oscillator for oscillating or agitating the flow of wash fluid passing into the dispenser housing; and a bi-directional pump for selectively urging a flow of wash fluid through the recirculation conduit.

12. The pump assembly of claim 11, wherein the inlet port is defined on a back wall of the dispenser housing.

13. The pump assembly of claim 11, wherein the inlet port defines a fan-shaped geometry to spread the flow of wash fluid.

14. The pump assembly of claim 11, wherein the dispensing assembly further comprises:

one or more dispersion fins extending from the dispenser housing adjacent the inlet port for directing the flow of wash fluid.

15. The pump assembly of claim 14, wherein the one or more dispersion fins are positioned above the inlet port along a vertical direction.

16. The pump assembly of claim 14, wherein the one or more dispersion fins are angled downward along a vertical direction to direct the flow of wash fluid downward.

* * * * *